US006203001B1

(12) United States Patent
Steinhilber

(10) Patent No.: US 6,203,001 B1
(45) Date of Patent: Mar. 20, 2001

(54) ARRANGEMENT FOR DEPOSITING SHEETS OUTPUT BY AN OFFICE MACHINE

(76) Inventor: Friedhelm Steinhilber, Schauinslandweg 13, Rottweil (DE), 78628

( * ) Notice: Subject to any disclaimer, the term of this patent is extended or adjusted under 35 U.S.C. 154(b) by 0 days.

(21) Appl. No.: 09/193,589

(22) Filed: Nov. 17, 1998

(30) Foreign Application Priority Data

Nov. 17, 1997 (DE) ..... 197 50 592

(51) Int. Cl.[7] ..... B65H 43/00

(52) U.S. Cl. ..... 270/59; 270/58.31; 270/58.32; 270/58.33; 270/39.04

(58) Field of Search ..... 271/186, 184; 270/58.31, 39.04, 59, 58.32, 58.33

(56) References Cited

U.S. PATENT DOCUMENTS

| | | | | |
|---|---|---|---|---|
| 2,169,932 | * | 8/1939 | Sweet et al. . | |
| 2,382,998 | * | 8/1945 | Kleinschmidt | 270/58.13 |
| 3,458,186 | * | 7/1969 | Schmidt | 270/58.13 |
| 4,253,652 | * | 3/1981 | Steinhilber | 271/8.1 |
| 4,416,559 | * | 11/1983 | Steinhilber | 400/629 |
| 4,624,452 | * | 11/1986 | Pulskamp | 270/58.04 |
| 4,763,161 | * | 8/1988 | Forest et al. | 399/84 |
| 4,944,503 | * | 7/1990 | Arima | 270/52.09 |
| 4,974,035 | * | 11/1990 | Rabb et al. | 399/374 |
| 5,272,511 | * | 12/1993 | Conrad et al. | 399/382 |
| 5,316,279 | * | 5/1994 | Corona et al. | 270/1.01 |
| 5,366,212 | * | 11/1994 | Crowley et al. | 270/58.31 |
| 5,918,879 | * | 7/1999 | Steinhilber | 271/279 |

FOREIGN PATENT DOCUMENTS

| | | | |
|---|---|---|---|
| 357135953A | * | 8/1982 | (JP) . |
| 362167170A | * | 7/1987 | (JP) . |
| 62290668A | | 12/1987 | (JP) . |
| 6360866A | | 3/1988 | (JP) . |
| 3-166164 | | 7/1991 | (JP) . |
| 404070772A | * | 3/1992 | (JP) . |
| 405270722A | * | 10/1993 | (JP) . |
| 405270723A | * | 10/1993 | (JP) . |
| 8-225228 | * | 9/1996 | (JP) . |

* cited by examiner

*Primary Examiner*—Christopher P. Ellis
*Assistant Examiner*—Richard Ridley
(74) *Attorney, Agent, or Firm*—Foley & Lardner; Bernard L. Kleinke

(57) ABSTRACT

The sheets (18) output from an office machine (10) are deposited in stacked form in a sheet depository (16). Combined with the sheet depository (16) is a tray or container (22) in which separating films (20) are stored. The separating films (20) are placed via a guiding device (26) onto the stack of sheets (18) in the sheet depository (16) in order to be able to separate associated groups of sheets (18) in a simple manner.

9 Claims, 1 Drawing Sheet

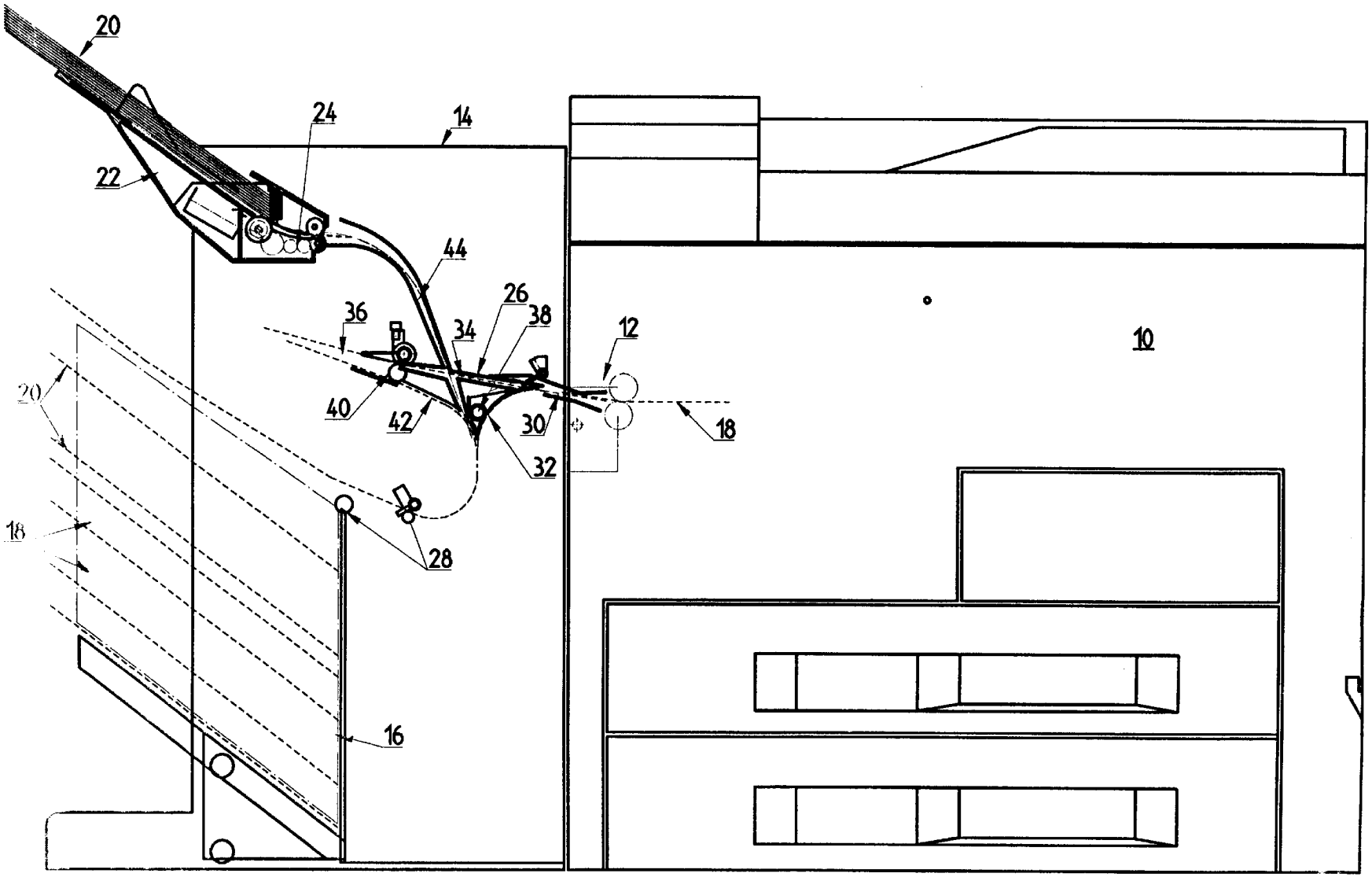
10
18
12
38
30
32
26
34
14
44
42
28
36
40
16
24
20
22
20
18

ARRANGEMENT FOR DEPOSITING SHEETS OUTPUT BY AN OFFICE MACHINE

CROSS-REFERENCE TO RELATED APPLICATIONS

This application is based on co-pending German Patent Application 19750 592.9 filed Nov. 17, 1997.

STATEMENT REGARDING FEDERALLY SPONSORED RESEARCH OR DEVELOPMENT

Not Applicable

REFERENCE TO A "MICROFICHE APPENDIX"

Not Applicable

BACKGROUND OF THE INVENTION

1. Technical Field

The invention relates to a device for depositing sheets output by an office machine, such as a computer printer or copier, according to the preamble of claim 1.

2. Background Art

In the case of numerous office machines, such as printers, telecopiers, copying devices etc., the sheets provided by the office machine with recordings are deposited in stacked form. If successive sheets which belong to different processes are deposited on the stack, it is necessary to select laboriously from the stack the sheet groups belonging to the individual processes. This is the case, for example, if several monitor work stations are connected to a common central printer, if different printing jobs are associated with different operators or if different documents are copied successively.

From Patents Abstracts of Japan M-657 (JP 62-167170 A) a copying device is known which comprises a supply tray for copying paper and a supply tray for separating films. After a group of associated copies have been deposited in stacked form in a deposit tray of the copying device, a separating film is deposited under control onto the stack. The separating films are longer than the sheets of the copying paper so that the separating films project from the stack in the deposit tray. In this way the associated sheets of a group can be readily separated and removed. The tray for the separating films is disposed at the supply tray for the copying paper. The separating films are transported through the copying device via the same transporting path as the copying paper. The separating films must therefore have substantially the same dimensions of width and the same material properties as the copying paper. The separating films are therefore not well suited for multiple use. Accordingly, simple placement of the used separating films back into the supply tray is not provided. From CH 647 735 A5 is known an arrangement for stacking folded printed sheets, in which the printed sheets drop into a stacking receptacle at the end of a conveying path and are stacked there. An associated group of printed sheets is each held together by an upper and a lower end plate. The end plates are individually supplied from a tray disposed above the stacking receptacle in holding devices, which deposit the end plates onto the stack of the printed sheets. The end plates have the same dimensions as the printed sheets and do not serve for dividing the stack but rather for pressing together the printed sheets.

From Patents Abstracts of Japan M-1168 (JP 3-166 164 A) is known an office machine in which at the holding bin for the recording paper also a holding bin for separating films is provided. After a group of sheets has been provided with recordings and deposited in stacked form in a deposit tray, a separating film is deposited under control onto the deposit stacking order to be able to separate the stack more readily. The separating films are transported from the holding bin through the office machine to the deposit tray with the separating films being transported by means of a shunt system past the recording station of the office machine. The arrangement for supplying the separating films is complicated and expensive. The dimensions of the separating film and the material properties are determined by the transport of the separating films through the office machine and cannot be freely selected. Accordingly, the separating films are poorly suited for multiple and repeated use and a simple placing-back of the used separating films into the supply bin is not provided.

In the case of all of these known arrangements the tray for the separating films is integrated into the office machine and the supply of the separating films to the sheet depository takes place through the office machine. It is therefore not possible, or at least very difficult to develop the same office machine optionally with or without a supply mechanism for separating films.

SUMMARY OF THE INVENTION

Therefore, the object of the present invention is to provide an arrangement for the deposition of sheets output by an office machine, to enable as an option selectively the deposition of separating films for separating the sheets deposited in stacked form.

The invention relates to the disposing of a tray or container for receiving separating films at the sheet depository and combining it with the latter to provide the capability of building or adding onto a commercially available office machine, alternatively to a conventional sheet depository for separating films. A guiding device of the structural unit serves for the purpose of supplying the sheets output by the office machine and, upon a control command, to supply the particular separating film to an ejection device, which conveys the sheets or the separating films into the sheet depository and deposit them on the stack.

BRIEF DESCRIPTION OF DRAWINGS

The above mentioned and other objects and features of this invention and the manner of attaining them will become apparent, and the invention itself will be best understood by reference to the following description of the embodiment of the invention in conjunction with the accompanying drawings, wherein:

In the following the invention will be described in further detail in conjunction with an embodiment example depicted in the drawing. FIG. 1 shows schematically the arrangement in vertical section.

BEST MODE FOR CARRYING OUT THE INVENTION

A commercially available office machine 10 is depicted only schematically. This office machine can be, for example, a printer or a copier. The office machine 10 comprises a sheet output 12 via which are output the sheets provided in the office machine 10 with recordings.

Adjoining the sheet output 12 the arrangement according to the invention is built or added onto the office machine 10 which is disposed in a housing 14.

The arrangement comprises a sheet depository 16 into which the sheets 18, output by the office machine 10, are deposited so as to be stacked. The sheet depository 16 is accessible on the side of the housing 14 facing away from the office machine 10 such that the stack of sheets 18 can be removed at this side. In order to be able to separate in simple manner associated groups of sheets 18 deposited on the stack, separating films 20 are provided which, in at least one dimension, have greater dimensions than the sheets 18 such that they project beyond the edge of the stack of sheets 18 and permit the simple separation of the stack.

The separating films 20 are kept in a tray 22 which is disposed in the housing 14 above the sheet depository 16. The tray 22 accepts a stack of separating films 20. The tray 22 comprises a singling device 24 by means of which the separating films 20 can be pulled singly from the tray 22. The singling device 24 can be realized in any manner known to the person skilled in the art. Since the separating films 20 can be used repeatedly, the separating films 20 comprise preferably synthetic material including thermoplastic material, paper or thin cardboard such that they have sufficient durability and stressability. The separating films 20 usefully comprise intrinsic rigidity and are resiliently flexible. The singling device 24 can be adapted to the dimensions and material properties of the separating films 20. By lifting the separating films 20 at their margin projecting beyond the stack of sheets 18, the stack can therefore be searched readily in order to find the desired group of sheets 18 and to pull them out of the stack. The tray 22 comprises a receptacle, open at the top, for the separating films 20 which receptacle is preferably freely accessible at the top of housing 14 such that the separating films 20, removed from the deposition stack and no longer required, can be readily placed back into the tray 22 and are available for further use in the tray 22.

In housing 14 there is further disposed a guiding device 26, which is combined with the sheet depository 16 and the tray 22 in the housing 14 to form a structural unit. The guiding device 26 serves the purpose of guiding the sheets 18 arriving from the sheet output 12 of the office machine 10 and, alternatively, the separating films 20 output by the tray 22 via its singling device 24 to the sheet depository 16 where the sheets 18, respectively the separating films 20, are grasped by ejection means 28, for example in the form of pairs of rollers, and transported to the sheet depository 16 and are there deposited on the stack.

After the housing 14 is added to the office machine 10, the guiding device 26 adjoins the sheet output 12 of the office machine 10. The guiding device 26 comprises a first sheet guide 30 which adjoins the sheet output 12 and which accepts the sheets 18 exiting from the sheet output 12. The first sheet guide 30 branches into a second sheet guide 32 and a third sheet guide 34. The second sheet guide 32 guides the sheets 18 downwardly to the ejection means 28. The third sheet guide 34 guides the sheets 18 to a turning station 36.

At the branching of the first sheet guide 30 into the second sheet guide 32 and the third sheet guide 34 a shunt 38 is disposed which can be switched over in order to direct or guide, under control, the sheets 18 entering from the sheet output 12 into the first sheet guide 30 optionally into the second sheet guide 32 or the third sheet guide 34. If the sheets 18 are supplied via the second sheet guide 32 directly to the ejection means 28 and transported by them into the sheet depository 16, the sheets 18 are deposited in the sheet depository 16 with the same orientation in which they are output by the office machine 10. If the sheets 18 are to be deposited after having been turned, the sheets 18 coming from the sheet output 12 are guided by means of shunt 38 via the third sheet guide 34 into the turning station 36.

After sheet 18 has been transported with its entire length into the turning station 36, sheet 18 is supplied by means of transport rollers 40 via a fourth sheet guide 42 to the ejection means 28. Therein the originally trailing rear edge of the sheet 18 is turned toward the front and its originally upper side is turned downwardly and deposited by the ejection means 28 in the sheet depository 16. The tray 22 is disposed in the housing 14 above the sheet depository 16 and the turning station 36 in such a manner that the singling device 24 supplies the separating films 20 from the tray 22 via a film guide 44 to the guiding device 26. The film guide 44 intersects in the guiding device 26 the third sheet guide 34 and terminates jointly with the second sheet guide 32 and the fourth sheet guide 42 in the direction of the ejection means 28.

While particular embodiments of the present invention have been disclosed, it is to be understood that various different modifications are possible and are contemplated within the true spirit and scope of the appended claims. There is no intention, therefore, of limitations to the exact abstract or disclosure herein presented.

What is claimed is:

1. Arrangement for depositing sheets output from an office machine into a sheet depository where the sheets are deposited in stacked form, comprising:

tray means for confining a plurality of separating films of different size relative to the sheets said films being discharged singly from said tray means and, for the separation of successive groups of associated sheets, placed on the sheets deposited in stacked form in the sheet depository;

ejection means for transporting the sheets and the separating films into the sheet depository and for depositing them therein; said tray means being disposed above the sheet depository;

guiding means for directing to the ejection means the sheets being discharged from the office machine and the separating films arriving from the tray means;

wherein said arrangement comprises a separate, self-contained unit to be mounted at the sheet output of the office machine to receive sheets being discharged therefrom and to receive said separating films, adaptable to fit a plurality of office machines; and said arrangement being disposed adjacent to the office machine at the sheet output therefore.

2. Arrangement as claimed in claim 1, wherein the sheet depository, the tray and the guiding means are disposed in a common housing.

3. Arrangement as claimed in claim 1 wherein the guiding means is disposed adjoining the sheet output of the office machine and guides the sheets arriving from the sheet output via a sheet guide to the ejection means of the sheet depository and guides the separating films via a film guide from the tray to the ejection means of the sheet depository.

4. Arrangement as claimed in claim 1, wherein the guiding means is associated with a turning station and further includes a shunt which, in a switchable manner, directs the sheets arriving from the sheet output either directly to the ejection means of the sheet depository or to the turning station from which they are supplied to said ejection means after their orientation has been changed.

5. Arrangement as claimed in claim 1, wherein the tray for the separating films is disposed above the sheet depository in the housing.

6. Arrangement as claimed in claim 5, wherein the tray comprises a receptacle, open at the top, for the emplacement of the separating films.

7. Arrangement as claimed in claim 5, wherein the tray is disposed in the housing such that the separating films exit from the tray in the direction toward the sheet output of the office machine and that the separating films can be placed into the tray from the side of the housing opposite the sheet output of the office machine.

8. Arrangement for depositing sheets output from an office machine into a sheet depository where the sheets are deposited in stacked form, comprising:

tray means for confining a plurality of separating films of different size relative to the sheets said films being discharged singly from said tray means and, for the separation of successive groups of associated sheets, placed on the sheets deposited in stacked form in the sheet depository:

ejection means for transporting the sheets and the separating films into the sheet depository and for depositing them therein; said tray means being disposed above the sheet depository;

guiding means for directing to the ejection means the sheets being discharged from the office machine and the separating films arriving from the tray means;

wherein said guiding means is associated with a turning station and further includes a shunt which, in a switchable manner, directs the sheets arriving from the sheet output either directly to the ejection means of the sheet depository or to the turning station from which they are supplied to said ejection means after their orientation has been changed; and said is disposed between said sheet depository and said tray for said separating films.

9. A method for depositing sheets output from an office machine into a sheet depository where the sheets are deposited in stacked form, comprising:

confining a plurality of separating films of different size relative to the sheets said films being discharged singly from said tray means and, for the separation of successive groups of associated sheets, placed on the sheets deposited in stacked form in the sheet depository;

transporting the sheets and the separating films into the sheet depository and for depositing them, therein; said tray means being disposed at the sheet depository; and directing to the ejection means the sheets being discharged from the office machine and the separating films arriving from the tray means.

* * * * *